US007686090B2

(12) United States Patent
Reimert et al.

(10) Patent No.: US 7,686,090 B2
(45) Date of Patent: Mar. 30, 2010

(54) LINER HANGER TOOL WITH RE-LATCHABLE CEMENTING BUSHING

(75) Inventors: Larry E. Reimert, Houston, TX (US); John M. Yokley, Kingwood, TX (US)

(73) Assignee: Dril-Quip Inc., Houston, TX (US)

( * ) Notice: Subject to any disclaimer, the term of this patent is extended or adjusted under 35 U.S.C. 154(b) by 207 days.

(21) Appl. No.: 11/796,214

(22) Filed: Apr. 27, 2007

(65) Prior Publication Data

US 2007/0251704 A1 Nov. 1, 2007

Related U.S. Application Data

(60) Provisional application No. 60/795,549, filed on Apr. 27, 2006.

(51) Int. Cl.
*E21B 23/00* (2006.01)

(52) U.S. Cl. ..... 166/382; 166/208; 166/381; 166/387

(58) Field of Classification Search ..... 166/382, 166/381, 387, 208
See application file for complete search history.

(56) References Cited

U.S. PATENT DOCUMENTS

| | | | |
|---|---|---|---|
| 3,920,057 | A | 11/1975 | Hamilton et al. |
| 4,281,711 | A | 8/1981 | Braddick et al. |
| 6,739,398 | B1 | 5/2004 | Yokley et al. |

*Primary Examiner*—Jennifer H Gay
*Assistant Examiner*—Brad Harcourt
(74) *Attorney, Agent, or Firm*—Browning Bushman P.C.

(57) ABSTRACT

A liner hanger assembly comprises a tool mandrel (104) suspended on a running string, and a slip assembly (120) for engaging a casing to support the liner hanger and liner from the casing. The release assembly (175) releases the set liner hanger from portions of the assembly to be retrieved to the surface. A cementing bushing (130) is releasable and reinsertable into the liner, and includes a circumferential loading ring (226).

19 Claims, 13 Drawing Sheets

LINER HANGER TOOL WITH RE-LATCHABLE CEMENTING BUSHING

RELATED CASE

The present application claims priority from U.S. Ser. No. 60/795,549 filed Apr. 27, 2006.

FIELD OF THE INVENTION

The present invention relates to downhole tools with sealing components to conduct cementing operations. More particularly, the present invention relates to a liner hanger assembly for hanging a liner in a well, and to a lockable and re-latchable cementing bushing.

BACKGROUND OF THE INVENTION

A cementing bushing, sometimes referred to as a packoff bushing, is used in a liner hanger assembly to seal between the liner and the running tool, which is lowered into the well on a running string. Once properly lowered, cement is discharged through the running string and around the liner in the well bore. The cementing bushing thus provides for the required increase in fluid pressure to pump cement in the well, and subsequently to selectively break the seal between the liner and the running tool.

Prior art cementing bushings use multiple lugs protruding out from the seal body to lock the bushing into the liner. These lugs may be small and limit the cementing pressure capability of the packoff bushing. An operator typically wishes to pick up the running tool after release from the liner hanger, and the running tool slick joint determines the length the running tool can be picked up before the cementing bushing comes out of the liner. If the operator picks up the running tool above a length of the slick joint, the packoff bushing may disengage from the liner hanger and cause a cementing failure. The entire assembly may then have to be retrieved, since it is not possible to regain pressure integrity.

U.S. Pat. Nos. 3,920,057 and 4,281,711 disclose a liner hanger assembly for hanging a liner in a well, with the assembly including a retrievable packoff bushing. A retrievable and re-stabbable cementing bushing is disclosed in U.S. Pat. No. 6,739,398. More particularly, the cementing bushing disclosed in the '398 patent may be pulled out of the liner and re-stabbed into the liner, although the possibility of pressure trapped below the cementing bushing detracts from the reliability of the system. TIW markets liner equipment with a retrievable packoff bushing and Smith International markets a retrievable cementing bushing with locking lugs. Weatherford markets a Nodeco RSM retrievable seal mandrel.

The disadvantages of the prior art are overcome by the present invention, and an improved liner hanger with a lockable and re-latchable cementing bushing is hereinafter disclosed.

SUMMARY OF THE INVENTION

According to one embodiment, a liner hanger assembly includes a tool mandrel supported from a running string, a slip assembly for setting slips to engage the casing and support the liner hanger from the casing, and a releasing mechanism for releasing the set liner hanger from portions of the tool to be returned to the surface.

The liner hanger assembly also includes a cementing bushing which may be re-inserted into the liner in the event that the running string is raised above the liner, thereby allowing pressure integrity to be re-established. The cementing bushing may be reinserted into the liner if, after setting and releasing from the liner, the setting tool is picked up out of the liner hanger while checking for the release of the running tool, or if upward movement of the drill string while cementing lifts the running tool above the liner hanger. A circumferential loading ring enhances the cementing pressure capability of the bushing, which has improved capacity and reliability, thereby providing more flexibility to the operator.

In one embodiment, a cementing bushing for sealing between a liner hanger and liner hanger running tool comprises a bushing body including a radially outward seal for sealing with the liner hanger and a radially inward seal for sealing with the running tool. A first C-ring or other locking member is axially moveable with the bushing body and radially moveable for axially interconnecting and disconnecting the bushing body and the liner hanger. A slick joint supported on the running tool allows the running tool to move upward while sealing with the radially inner seal of the bushing. A second C-ring or other locking member is positioned on the slick joint, and expands to connect the bushing to the slick joint when moved upward. When the slick joint is subsequently lowered and the first C-ring begins to reenter the groove, the buttons are forced radially inward, collapsing the second C-ring to disconnect the bushing from the slick joint. The first locking member is thus reengaged with the liner hanger and the second locking member releases the bushing from the slick joint.

According to one embodiment, the method of sealing between a liner hanger and a liner hanger running tool includes positioning a bushing body including a radially outward seal for sealing with the liner hanger and a radially inner seal for sealing with the running tool. The first locking member axially interconnects the bushing body and the liner hanger, and is raised upward to disengage from the liner hanger when moving the running tool upward, thereby raising a slick joint supported on the running tool which seals with the bushing body. A second locking member axially supported on the slick joint moves upward to axially secure the bushing to the slick joint.

These and further features and advantages of the present invention will become apparent from the following detailed description, wherein reference is made to the figures in the accompanying drawings.

DETAILED DESCRIPTION OF PREFERRED EMBODIMENTS

Figure 1A:
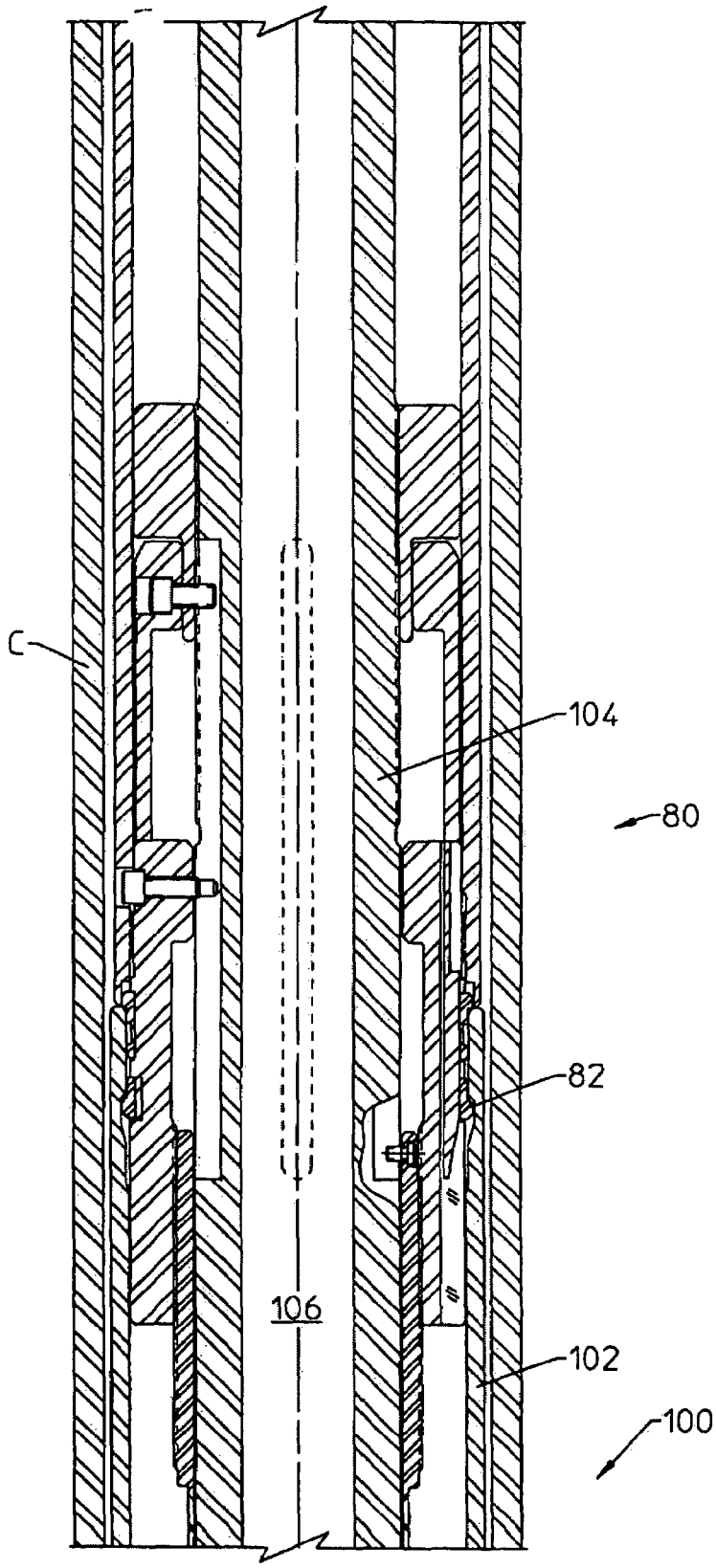
FIGS. 1A through 1G illustrate sequentially the primary components of a suitable liner hanger running tool.
Figure 1B:
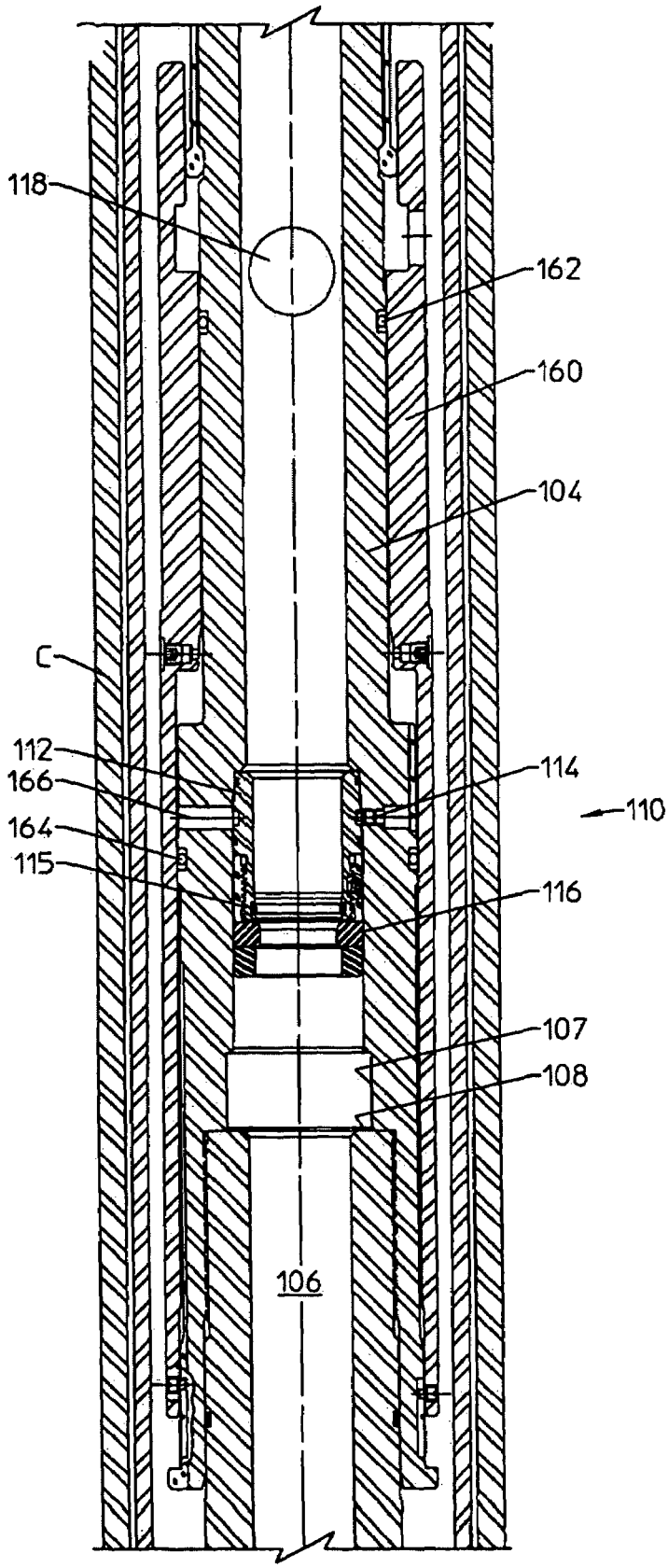
Figure 1C:
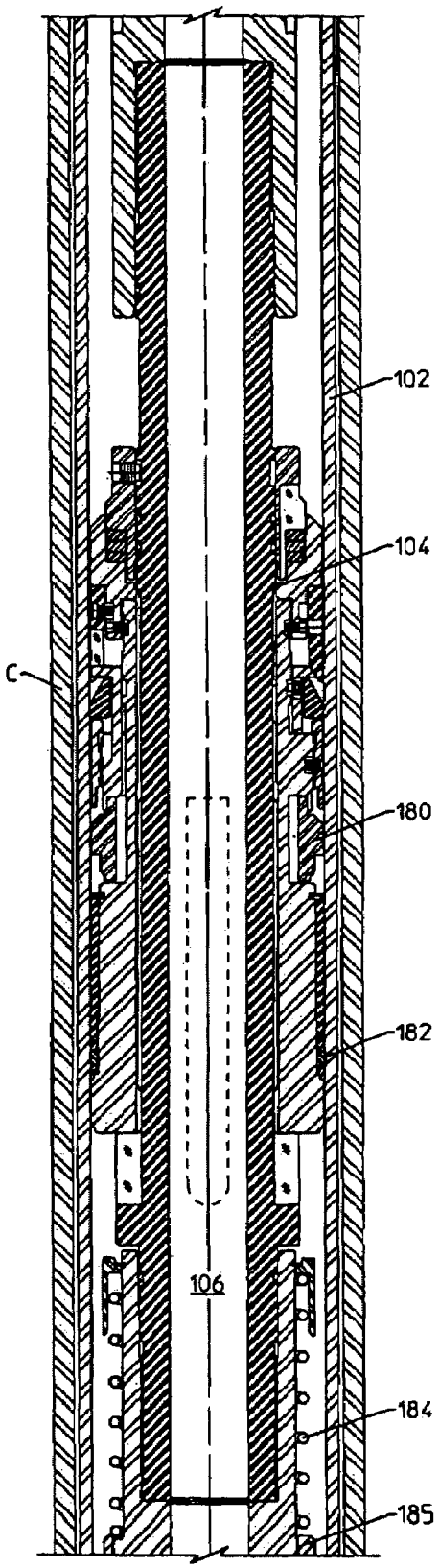
Figure 1D:
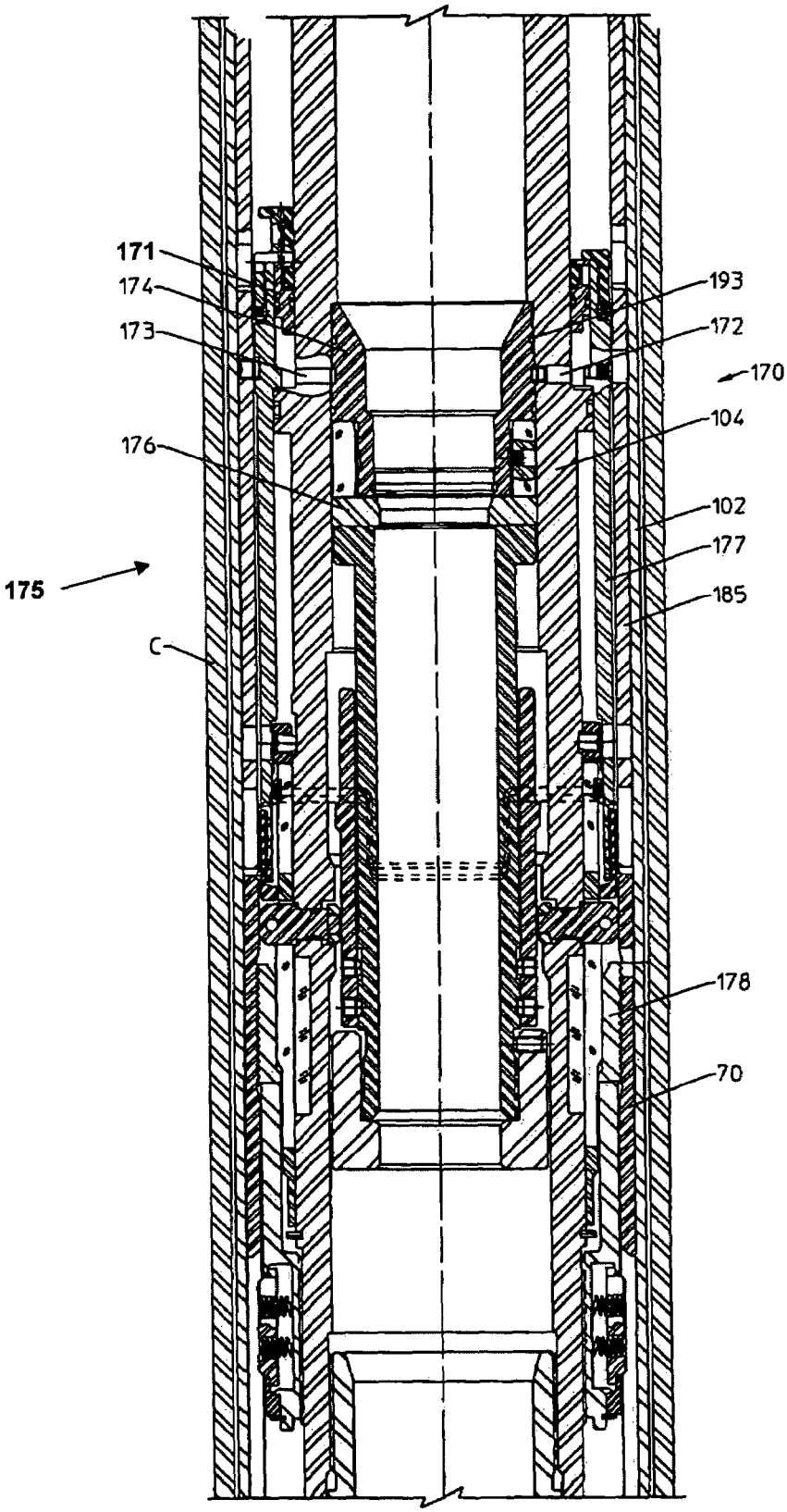
Figure 1E:
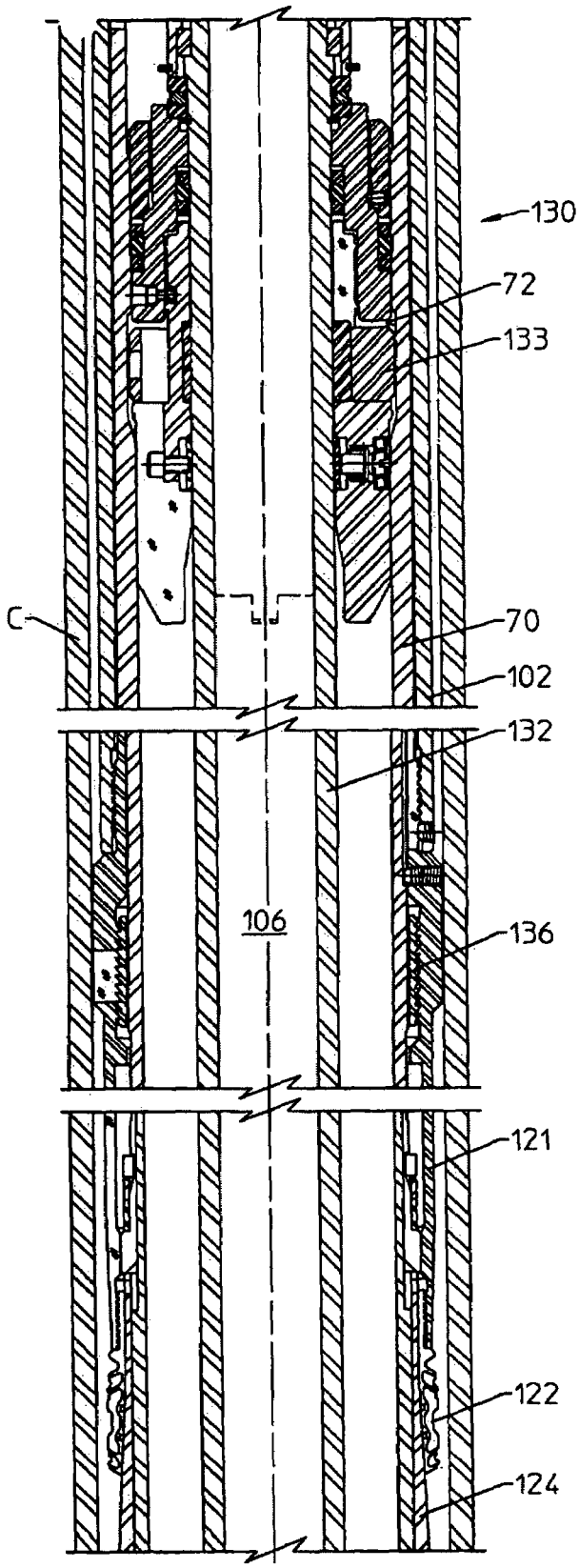
Figure 1F:
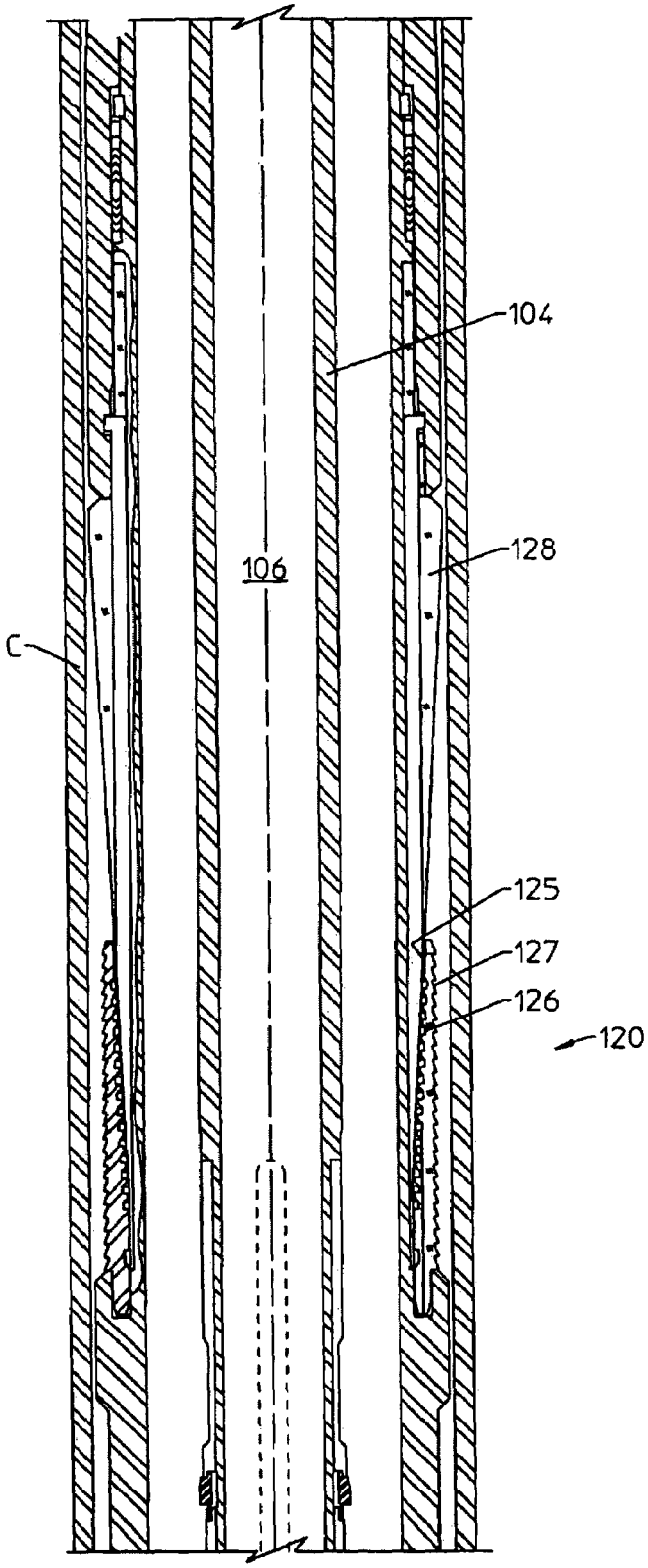
Figure 1G:
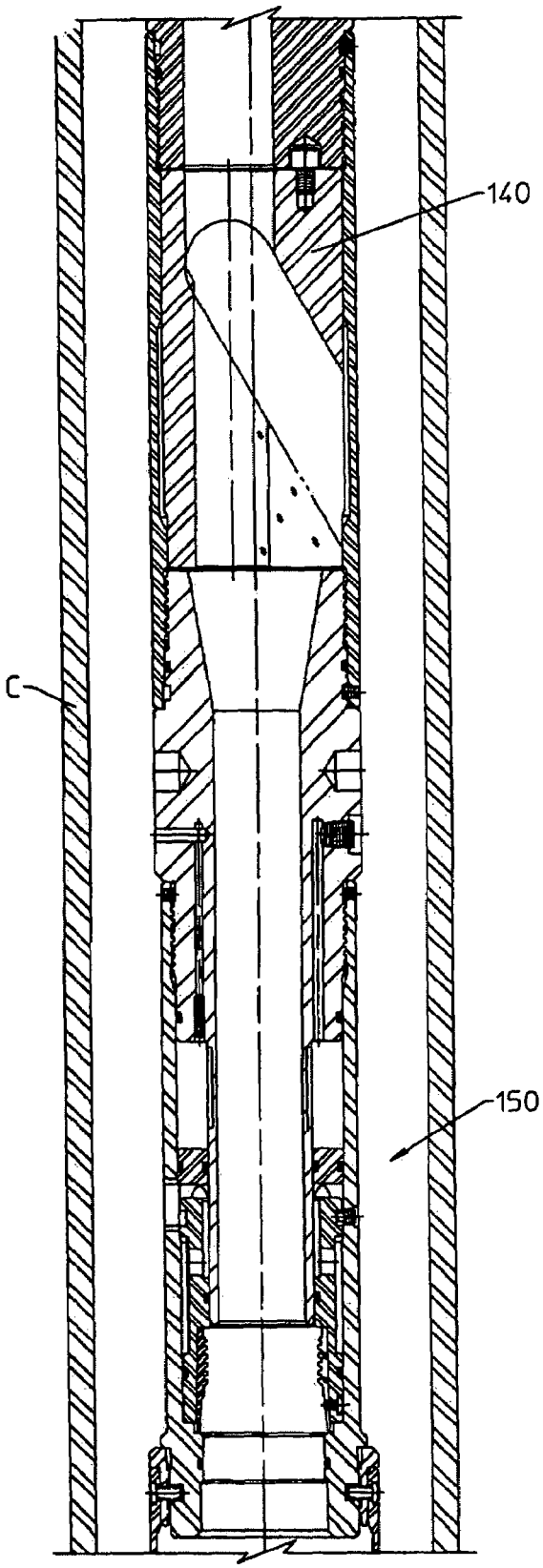

FIG. 1, which consists of FIGS. 1A-1G, illustrates one embodiment of a liner hanger tool 100 with two C-ring seat subassemblies each for seating with a closure member in a liner hanger application. An upper C-ring seat subassembly 110 is shown in FIG. 1B, and a lower C-ring seat subassembly 170 is shown in FIG. 1D. Other than components associated with seating and releasing the closure member, the primary components of the liner hanger running tool 100 as shown in FIG. 1 include a running tool tieback locking mechanism 80 (FIG. 1A), a slip release assembly operatively responsive to the upper C-ring seat assembly 110, packer setting ring 180 (FIG. 1C), a liner hanger release assembly 175 operatively responsive to the lower C-ring seat assembly (FIG. 1D), a cementing bushing 130 (FIG. 1E), and a ball diverter 140 and plug release assembly 150 (FIG. 1G). FIG. 1E illustrates the packer 122 and FIG. 1F illustrates the slip assembly 120, which are not part of the running tool retrieved to the surface, and remain downhole with the set liner. The cementing bushing 130 disclosed more fully below may be reinserted or re-stabbed into the liner so that pressure integrity can be reestablished between the running tool and the liner hanger assembly for circulation purposes. The cementing bushing may be retrieved to the surface after the cementing operation is complete.

To hang off a liner, the running tool 100 is initially attached to the lower end of a work string and releasably connected to the liner hanger, from which the liner is suspended for lowering into the bore hole beneath the previously set casing or liner C.

A tieback receptacle 102 as shown in FIG. 1A is supported about the running tool 100. The upper end of the tieback receptacle 102, upon removal of the running tool, provides for a casing tieback (not shown) to subsequently extend from its upper end to the surface. The tool 100 includes a central mandrel 104, which may comprise multiple connected sections, with a central bore 106 in the mandrel. The lower end of the tieback receptacle 102 is connected to the packer element pusher sleeve 121, as shown in FIG. 1E, whose function will be described in connection with the setting of the packer element 122 about an upper cone 124, as well as setting of the slips 126 about a lower cone 128 (see FIG. 1F).

By incorporating an axially movable slick joint 132 (which may functionally be an extension of the mandrel 104), the running tool may be axially moved relative to components to remain in the well without breaking the seal provided by the cementing bushing 130 (see FIG. 1E). The cementing bushing 130 provides a retrievable and re-stabbable seal between the running tool 100 and the liner hanger assembly for fluid circulation purposes.

FIG. 1A also illustrates a tieback locking mechanism 80. A split ring 82 locks the tieback 102 to the running tool mandrel 104. The tieback locking mechanism prevents premature actuation of the tool as it is run in the well. The locking mechanism 80 unlocks the tieback 102 to allow the slips 126 to be set. More particularly the slips 126 are kept from prematurely setting as the tool 100 is run into the wellbore by the tieback locking mechanism 80, which grippingly engages the upper end of the tieback 102 to prevent its upward movement prior to setting the slips.

The tool actuator subassembly 110 as shown in FIG. 1B is used to release the liner hanger slips for setting, and includes a sleeve 112 disposed within and axially moveable relative to the running tool mandrel 104. The sleeve 112 is held in its upper position by shear pins 114. A C-ring ball seat 116 is supported in the sleeve 112. A seal 115 is provided for sealing with the seated ball. A ball 118 may thus be dropped from the surface into the running tool bore 106 and onto the seat 116. An increase in fluid pressure within the mandrel 104 above the seated ball will shear the pins 114 and lower the ball seat 116 and sleeve 112 to a lower position in the bore of the running tool, e.g., against the stop shoulder 108. Once the subassembly is lowered, fluid pressure may pass through ports 166 to stroke a piston and thereby release the slips for setting.

Piston sleeve 160 is disposed about and is axially moveable relative to mandrel 104. An upper sealing ring 162 is disposed about a smaller O.D. of the running tool mandrel than is the lower sealing ring 164 to form an annular pressure chamber between them for lifting the tieback receptacle 102 from the position shown in FIG. 1B to an upper position for setting the slips or slip segments 126. Ports 166 formed in the running tool mandrel 104 connect the running tool bore with the surrounding pressure chamber once the seat 116 and sleeve 112 are lowered. An increase in pressure through the ports 166 will raise the piston sleeve 160. Upward movement of the piston sleeve 160 causes its upper end to raise the tieback receptacle 102, and also raise the slips 126.

The slip assembly 120 shown in FIG. 1F is made up of arcuate slip segments 126 received within circumferentially spaced recesses in slip body sleeve about the lower end of the liner hanger and adjacent the lower cone 128. Each slip segment 126 includes a relatively long tapered arcuate slip having teeth 127 on its outer side and an arcuate cone surface 125 mounted on its inner side for sliding engagement with lower cone 128. Three or more circumferentially spaced slip segments may be used. Alternatively, a one piece C-slip may be used to replace the slip segments. The teeth 127 are adapted to bite into the casing C as the liner weight is applied to the slip. The slips 126 are thus movable vertically between a lower retracted position, wherein their outer teeth 127 are spaced from the casing C, and an upper position, wherein the slips 126 have moved vertically over the cone 128 and into engagement with the casing C.

FIGS. 1E and 1F show the relationship of both the packer element 122 and the circumferentially spaced slips 126 about the upper 124 and lower 128 cones, respectively. The annular packer element 122 is disposed about a downwardly-enlarged upper cone 124 beneath the pusher sleeve 121. The packer element 122 is originally of a circumference in which its O.D. is reduced and thus spaced from the casing C. However, the packer element 122 is expandable as it is pushed downwardly over the cone 124 to seal against the casing.

FIG. 1E generally illustrates the cementing bushing 130. The cementing bushing provides a retrievable and re-stabbable seal between the running tool and the liner hanger for fluid circulation purposes prior to cementing, and also for the cementing operation. The cementing bushing 130 cooperates with the slick joint 132 to allow axial movement of the running tool without breaking the seal provided by the cementing bushing. The mandrel 104 of the released running tool can be used to raise the cementing bushing 130 to cause the lugs 133 to move in and unlock from the liner hanger. The liner hanger 70 is shown with an annular groove 72 for receiving the lugs 133. The cementing bushing 130 seals between a radially outward liner running adapter of the liner hanger and a radially inward running tool mandrel.

Ratchet ring 136 is also shown in FIG. 1E. This ratchet ring allows the packer element 122 to be pushed downward over the upper cone 124, then locks the packer element in its set position.

The packer element 122 may be set by using spring-biased pusher C-ring 180 (see FIG. 1C) which, when moved upwardly out of the tieback receptacle 102, will be forced to an expanded position to engage the top of the tieback receptacle. The released running tool may be picked up until the packer setting subassembly is removed from the top of a tieback receptacle, so that the pusher C-ring 180 is raised to a position above the top of the tieback receptacle and expanded outward. When the packer setting assembly is in this expanded position, weight may be slacked off by engaging the pusher C-ring 180 to the top of the tieback 102, which then causes the packer element 122 to begin its downward sealing sequence. When weight is set down, the expanded pusher C-ring 180 transmits this downward force through the tieback receptacle 102 to the pusher sleeve 121, and then the packer element 122 (see FIG. 1E). This weight also activates a sealing ring 182 (see FIG. 1C) between the packer setting assembly and the tieback receptacle to aid in setting the packer element with annulus pressure assist. The lower portion of FIG. 1C illustrates the upper portion of a clutch 185 splined to the OD of the running tool mandrel 104 to transmit torque while allowing axial movement between the clutch and the mandrel. The central portion of the clutch 185 is shown in FIG. 1D, and may move in response to biasing spring 184.

The first time the packer setting assembly is moved out of the polished bore receptacle running tool, a trip ring may snap to a radially outward position. When the packer setting assembly is subsequently reinserted into the polished bore receptacle, the trip ring will engage the top of the polished bore receptacle, and the packer setting C-ring is positioned within the polished bore receptacle. When set down force is applied, the trip ring will move radially inward due to camming action. The entire packer setting assembly may thus be lowered to bottom out on a lower portion of the running adapter prior to initiating the cementing operation. The next time the packer setting assembly is raised out of the polished bore receptacle, the radially outward biasing force of the C-ring will cause the C-ring to engage the top of the tieback. Further details regarding the packer seating assembly are disclosed in U.S. Pat. No. 6,739,398.

The packer element 122 may be of a construction as described in U.S. Pat. Nos. 4,757,860 and 6,666,276, comprising an inner metal body for sliding over the cone and annular flanges or ribs which extend outwardly from the body to engage the casing. Rings of resilient sealing material may be mounted between such ribs. The seal bodies may be formed of a material having substantial elasticity to span the annulus between the liner hanger and the casing C.

The C-ring seat subassembly 170 as shown in FIG. 1D may be disposed beneath the upper C-ring seat subassembly 110 shown in FIG. 1B. The lower C-ring seat subassembly 170 is secured within the running tool bore by shear pins 172. Sleeve 174 thus supports seat 176. The ball 118 when released from the upper seat will land onto the lower seat 176. Once the ball is seated, the predetermined pressure may be applied to shear pins 172 and move the ball seat 176 and the sleeve 174 downward to uncover the ports 173. Higher fluid pressure may then be applied to cause the piston sleeve 177 to move upward and thereby disengage the running tool from the set liner hanger. The release assembly 175 includes components pins 172, ports 173, ball seat 174 and piston 177, and releases the set liner hanger from the portion of the tool to be retrieved to the surface. Assembly 175 releases the remainder of the tool to be retrieved to the surface from the set liner. Upon raising of the inner piston 177, the running tool may be raised from the set liner hanger, but prior to setting of the packer, thus releasing the ball and permitting circulation of cement downwardly through the tool and upwardly within the annulus between the set liner and the casing.

FIG. 1D also illustrates a hydrostatic balance piston 171 for balancing fluid pressure across the seal 193 to increase high reliability for the operation of sleeve 174. Seals 193 above and below port 173 are thus subjected to substantially the same fluid pressure on both sides of the seals, thereby enhancing operation of the sleeve 174. FIG. 1D also illustrates split ring 178 for gripping the liner hanger 70. The split ring may be moved radially to position so that it may contract radially inward, thereby releasing the running tool from the liner hanger.

FIG. 1G illustrates a lower portion of the tool, including a ball diverter 140 and a liner wiper plug release assembly 150. The assembly 150 replaces the need for shear screws to secure the liner wiper plug to the running tool. The plug holder shown in FIG. 1G is functionally similar to the plug release assembly disclosed in U.S. Pat. No. 6,712,152. Tool components and operations not detailed herein may be functionally similar to the components and operations discussed in U.S. Pat. No. 6,681,860.

After activating the lower C-ring seat subassembly 170, the operator may lift up the tool to pass the ball through seat 176. A drop in pressure will indicate that the ball has passed through the ball seat, allowing circulation through the running string to continue, and the ball to be pumped downwardly into the ball diverter. Fluids are then circulated through the tool awaiting cement displacement. Cement is then injected through the running tool, and pump down plug follows the cement and the liner wiper plug to form a barrier to the previously displaced cement and the displacement fluid.

Figure 2:
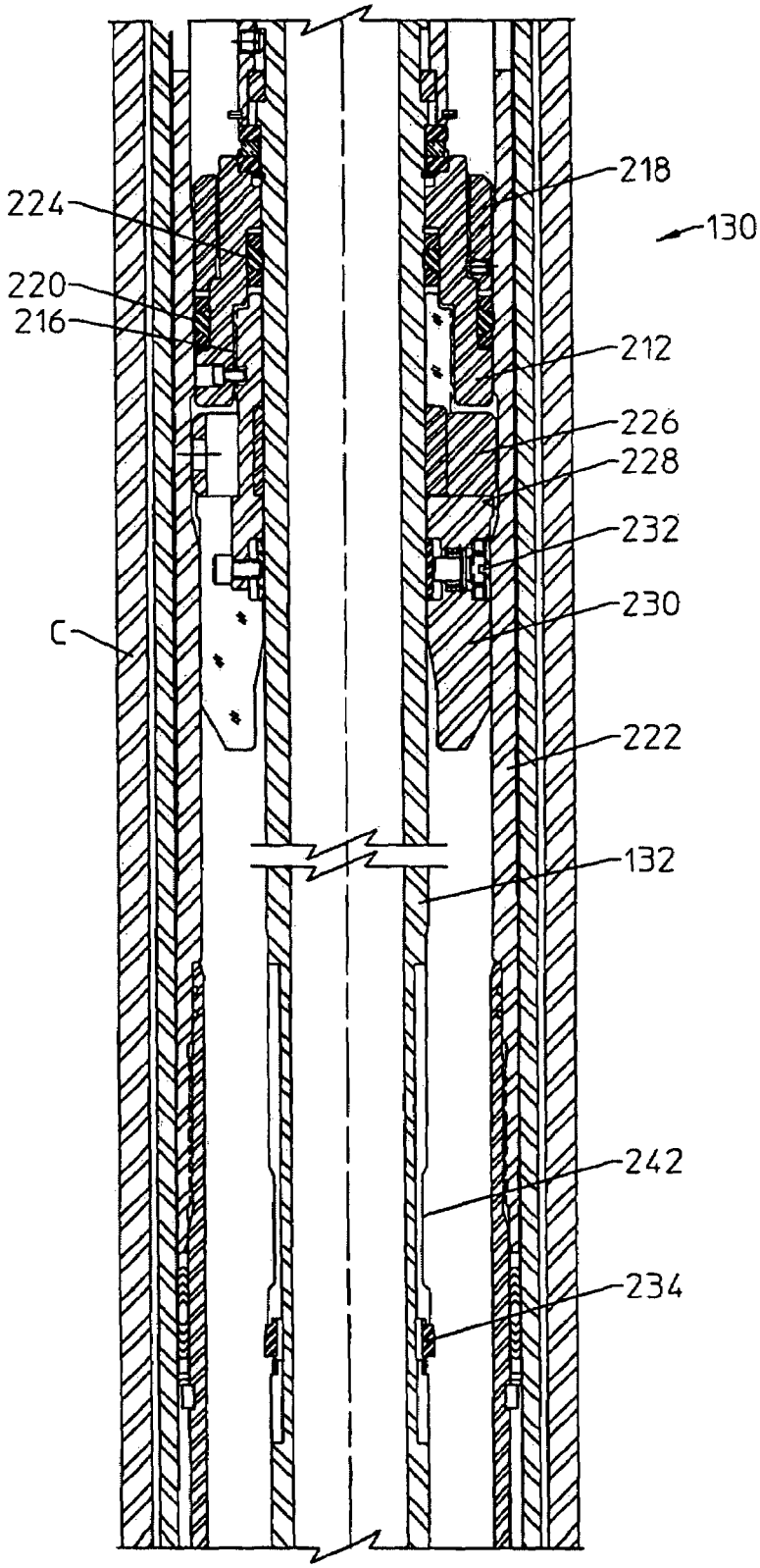
FIG. 2 illustrates in greater detail a half sectional view of a cementing bushing locked to a running adapter of a liner hanger.
Figure 3:
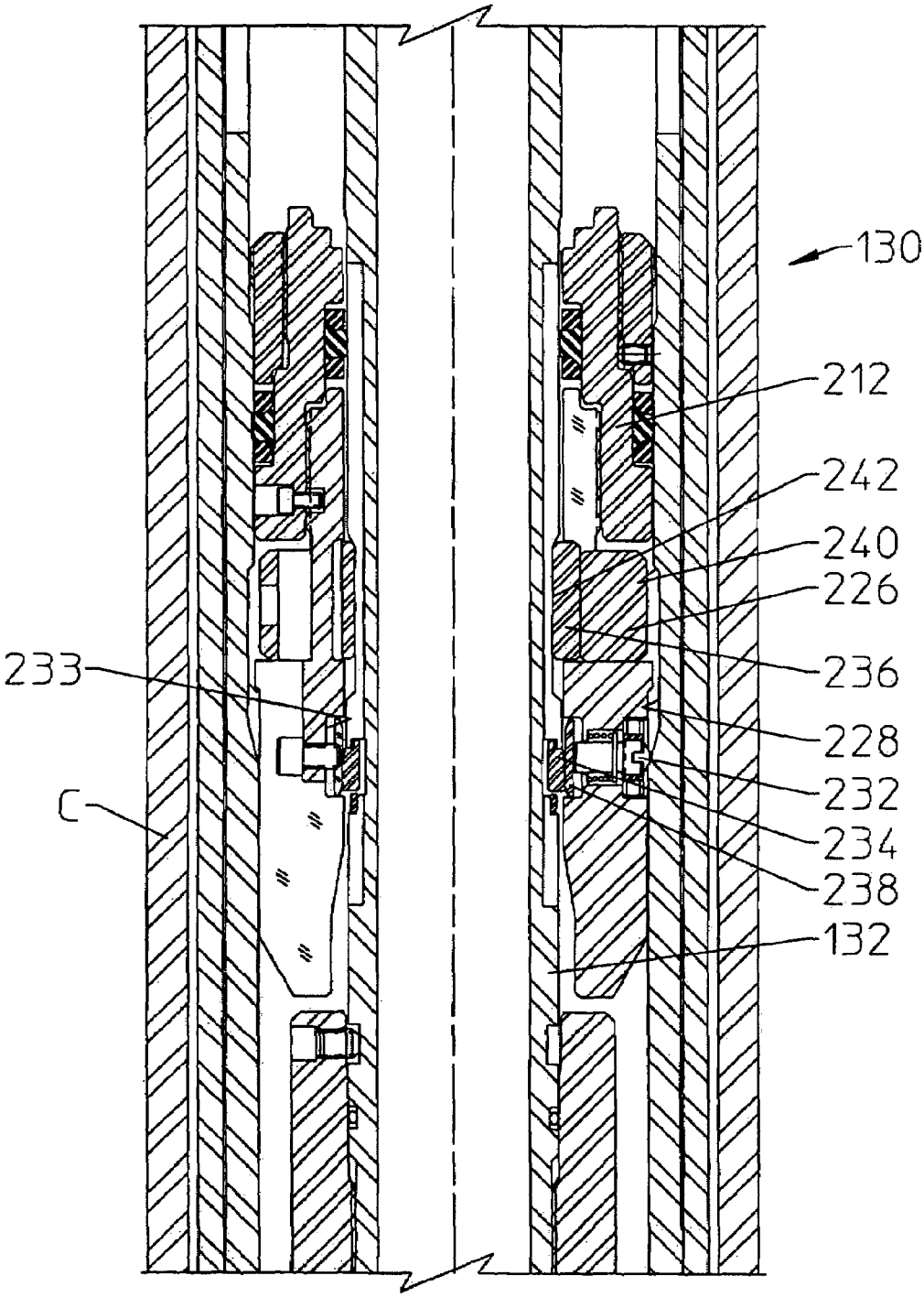
FIG. 3 illustrates the cementing bushing as shown in FIG. 2 disengaged from the locking groove in the running adapter, and a lower locking ring supported on a slick joint.

Referring now to FIGS. 2 and 3, the cementing bushing 130 is constructed to be retrieved after the cementing operation is complete along with the running string. The cementing bushing is also designed to be re-insertable into the liner hanger in the event that the running string lifts the cementing bushing above the liner, thereby enabling pressure integrity to be reestablished. The cementing bushing may also be reinserted in the liner if, after setting and releasing from the liner, the setting tool is picked up and the cementing bushing is raised out of the liner.

As shown in FIG. 2, the cementing bushing assembly 130 is shown in its normal position locked to the liner hanger, and includes a metal top sub 212 and a lower housing 230 which are connected by threads 216. A no-go cap 218 is also threaded to the top sub, and positions outer seal 220 for sealing engagement with the running adapter 222 of the liner hanger. The top sub 212 and the lower housing 230 also position an inner seal 224 for sealing with the slick joint 132. The assembly further includes a first locking member, such as a radially inward biased C-ring 226, which is shown positioned within a groove 228 in the inner surface of the adapter 222 when the cement bushing is normally locked in place. The first locking member also functions as a loading member, as explained subsequently, and occupies a majority of a circumferential groove when in a loading position. The C-ring 226 is positioned axially between a top sub 212 and a lower housing 230, which may be connected by threads 216. A plurality of circumferentially arranged buttons or plungers 232 in housing 230 move radially outward and inward, as explained below. Slick joint 132 also supports a lower C-ring 234, which may be positioned in a groove or otherwise positioned on the slick joint to move upward with the slick joint.

FIG. 3 shows in greater detail the upper lock ring 226 and a lock ring support 236 with the upper lock ring coming out of the groove 228 by pulling upward on the tool and thus raising the slick joint 132. Due to the recess or groove 242 on the outer surface of the slick joint 132, both the upper lock ring and the lock ring support may move radially inward as upward force applied to the tool lifts the upper lock ring 226 out of the locking groove 228 and positions the support 236 within the groove 242. At substantially the same time, the C-ring 234 moves out into the groove 233 in the cementing bushing to lock the bushing to the slick joint. When the slick joint is picked up, the upper lock ring 226 will thus engage the frustroconical surface 240 and be forced radially inward out of the groove 228, and into the groove 242 provided in the slick joint 132. The C-ring 226 may be biased radially inward, but may be normally held in the groove 228 by the O.D. of slick joint 132, which prevents its inward collapse. When the slick joint moves up so that surface 242 (see FIG. 2) is axially aligned with the C-ring 226, the C-ring naturally collapses inward to move out of the groove 228. The upper lock ring 226 contracts into the upper lock ring undercut 242 in the slick joint, and substantially simultaneously the lower lock ring 234 locks into groove 233. At this stage, the cementing bushing is locked to the slick joint by the lower locking ring 234.

Figure 4:
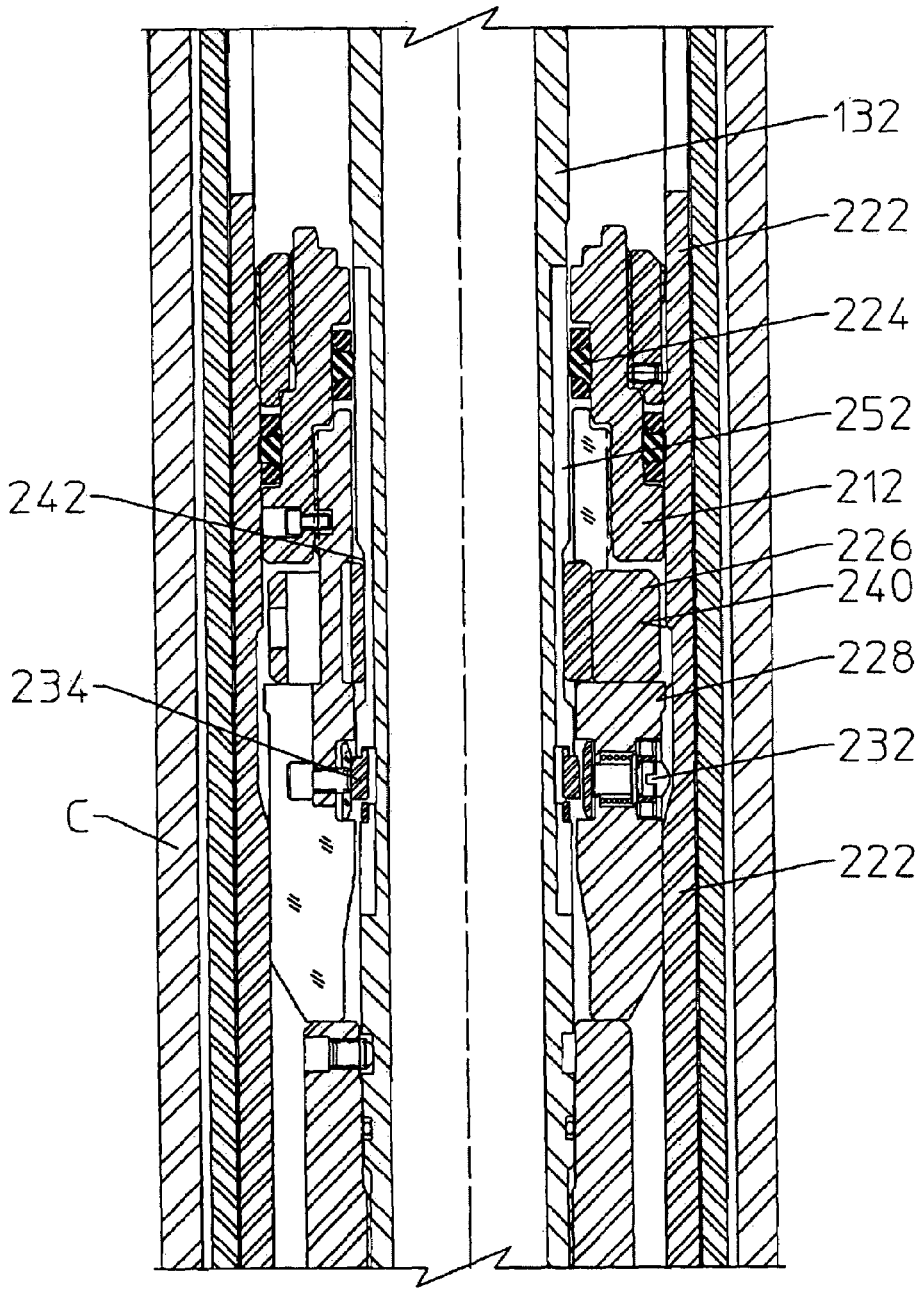
FIG. 4 shows a cementing bushing as shown in FIGS. 2 and 3 with the upper locking ring axially released from the liner hanger.

FIG. 4 illustrates the slick joint 132 in an upward position with the first C-ring 226 out of the groove 228, so that continued raising of the running tool may pull the cement bushing out of the liner hanger. The inner diameter of the liner hanger running adaptor 222 above the groove 228 is more than the inner diameter of the liner hanger adaptor below groove 228, so that the buttons 232 may pass upward of the groove 228 without collapsing the C-ring 234 radially inward. A portion of the slick joint 132 may include one or more vertical slots or cuts, such as slot 252 shown in FIG. 4, which extends from above the recess 242 to below the ring 234. These cuts or slots allow venting from above the recess 242 to below the lock ring 234, so that fluid may vent from above to below the bushing when in the FIGS. 3-6 positions. When in the FIGS. 2 and 7 positions, these bypass slots are below the seal 224 which seals with the slick joint 132.

Figure 5:
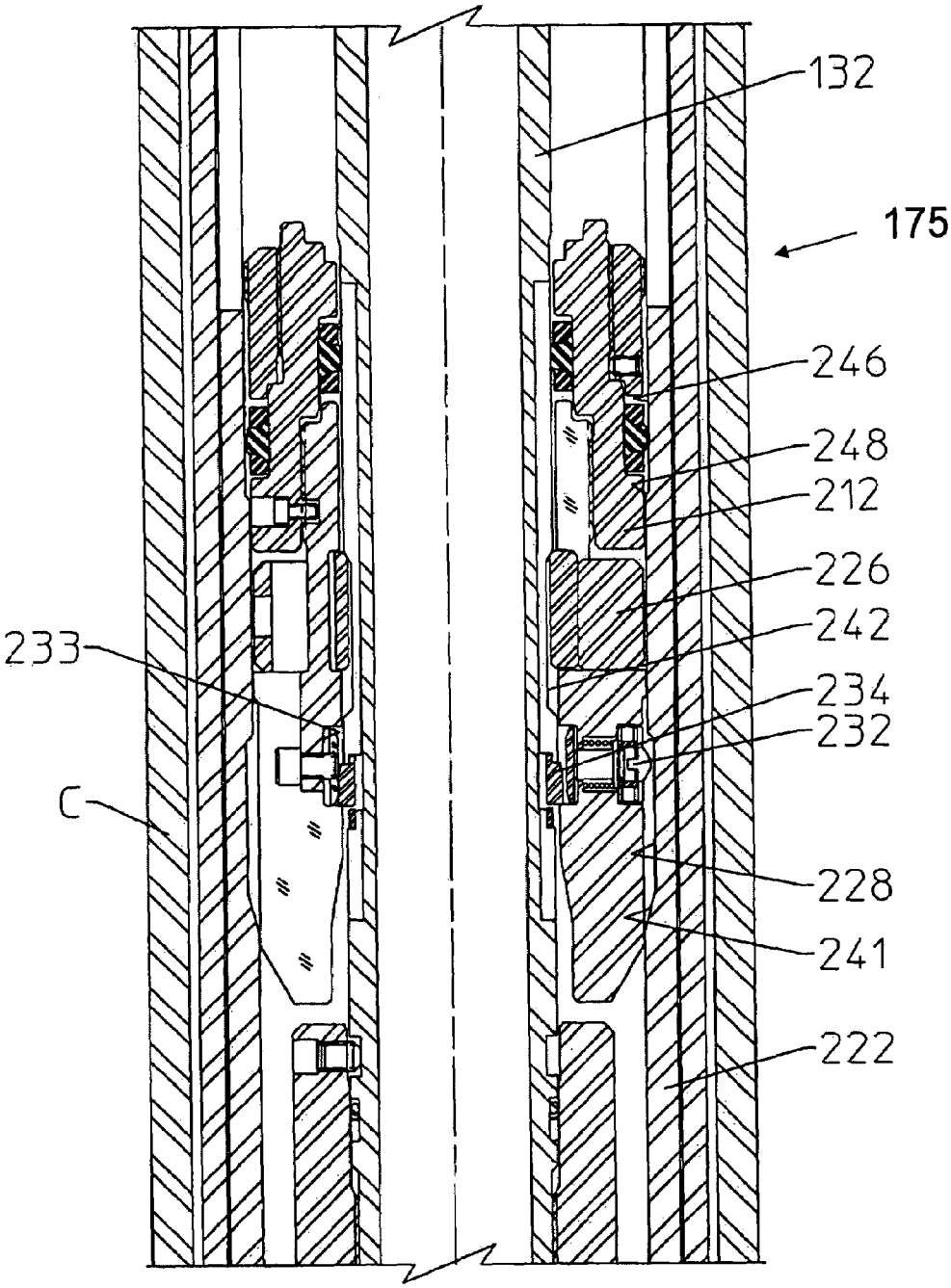
FIG. 5 illustrates the position of the cementing bushing when being stabbed back into the liner hanger.

FIG. 5 illustrates the concept that the cementing bushing may be easily restabbed into the liner hanger even if raised above the top of the liner hanger. The cementing bushing 130 may thus initially be stabbed into the larger inner diameter 246 at the top of the liner hanger adapter, with tapered surface 248 acting as a guide when lowering the bushing. In the FIG. 5 position, the plungers 232 will be forced radially inward as the bushing moves down and the buttons 232 engage the conical cam surface 241 at the lower end of slot 228 to collapse the ring 234 and unlock the bushing from the slick joint. The upper lock ring 226 may simultaneously be lowered to the position as shown in FIG. 6, where it is axially in line with the groove 228, but is not forced radially outward into the locked position due to the undercut or groove 242 in the slick joint 132.

Figure 6:
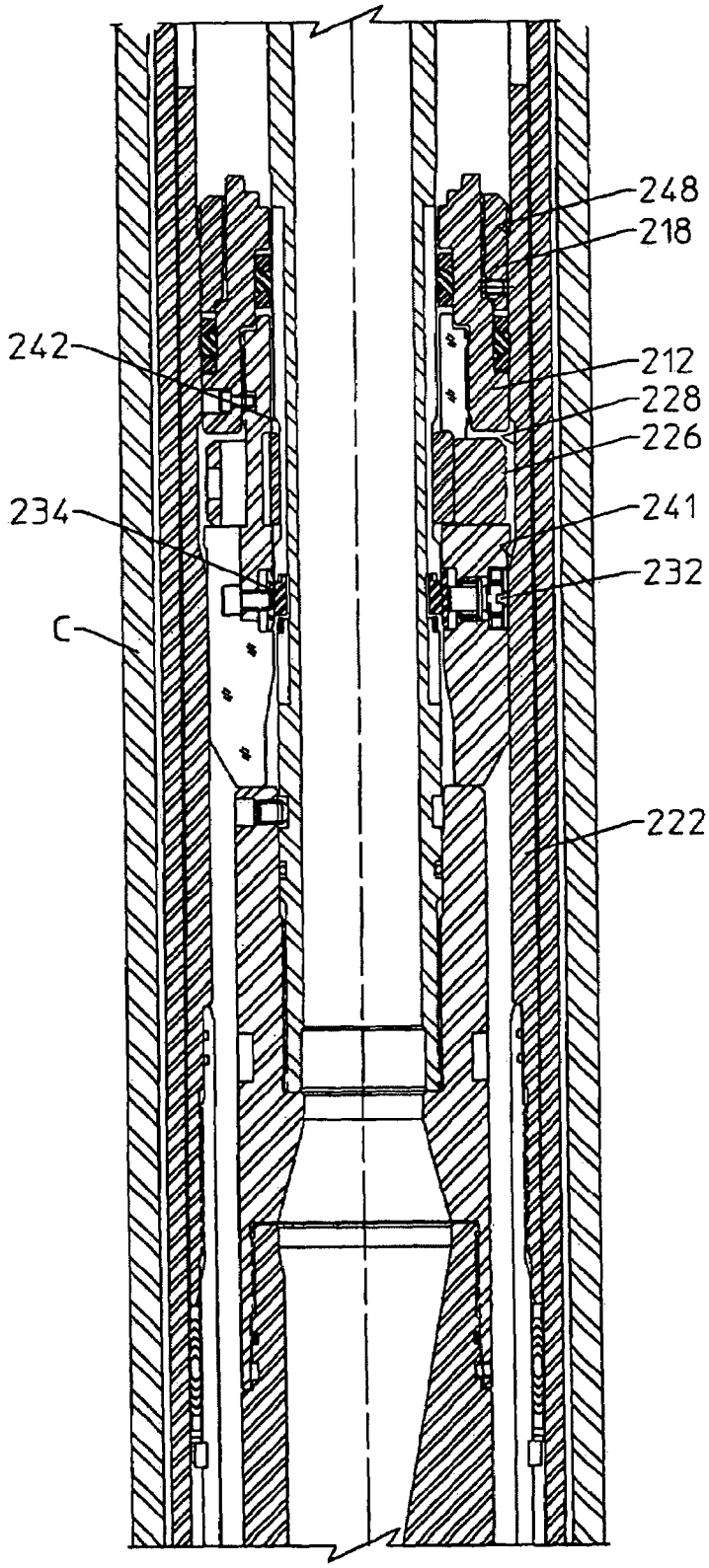
FIG. 6 illustrates a stop on the cementing bushing engaging a shoulder on the liner hanger, with the buttons lowered below the locking groove and the second locking member compressed to allow slick joint to move down to lock bushing to hanger.

FIG. 6 illustrates the no-go end cap 218 engaging the tapered shoulder 248 of a liner hanger running adapter 222. Shoulder 248 allows downward forces to be applied to the liner hanger to push the liner and hanger in the well. At this stage, the plungers or buttons 232 have been pushed radially inward due to the frustroconical surface 241, thereby collapsing the outwardly biased C-ring 234 to unlock the C-ring 234 from the bushing.

Figure 7:
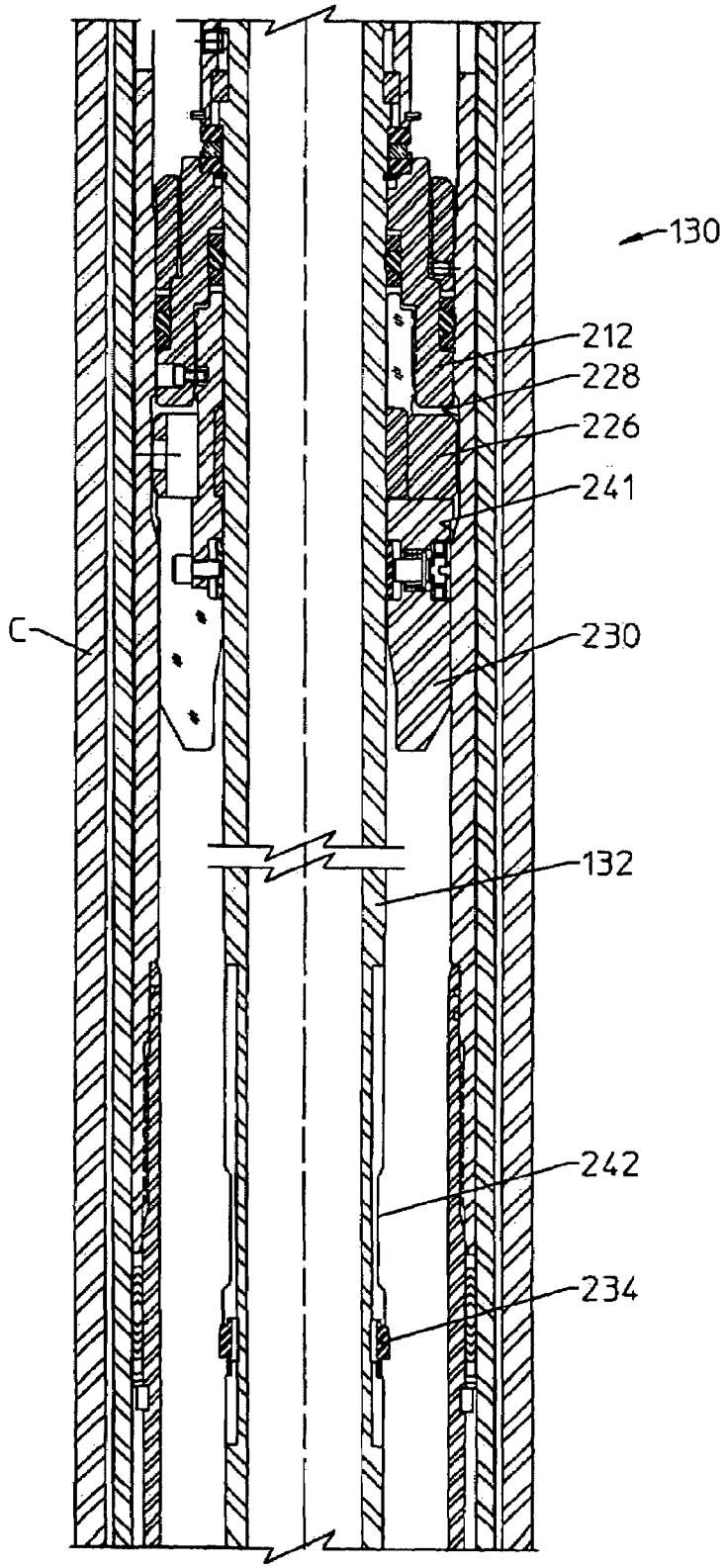
FIG. 7 illustrates the upper locking ring again positioned within the locking ring groove, the buttons positioned below the locking ring groove, and the lower locking ring retained on the slick joint.

As shown in FIG. 7, slick-joint 132 has been lowered so that the C-ring 234 is substantially below the lower housing 230, and the recessed groove 242 has been moved below the groove 228 in the liner hanger. C-ring 226 thus again locks the bushing to the liner hanger, and provides a large area, substantially continuous circumferential member capable of transmitting high forces to the liner hanger.

The ability of the cementing bushing to improve the function and reliability of the tool give the operator flexibility while picking up during the release of the running tool. If the cementing bushing unseats while being picked up more than an intended amount, the cementing operation may be subsequently resumed by re-stabbing the cementing bushing into the liner. The circumferential locking ring 226 of the bushing significantly increases the cementing pressure capacity of the bushing. The locking ring 226 is both sizable in cross-section and does not include cuts or bypasses other than the slot in the C-ring, thereby providing a large surface area for contact with the liner hanger.

As disclosed above, the first locking member preferably is a C-ring which is radially expandable to fit within a circumferential groove or slot in the liner hanger, and is radially contractible to move out of the groove. The second locking member may also be a C-ring which moves outward to connect and inward to disconnect the bushing from the slick joint. This second C-ring is biased radially outward to lock the bushing to the slick joint, and when moved radially outward, moves the buttons outward. The buttons subsequently move inward to contract the C-ring, and allow the slick joint to move downward, thereby allowing the first locking member to expand and reenter the locking groove to lock the bushing to the liner hanger, and simultaneously releasing the second locking member to axially release the bushing from the slick joint.

It is a feature to the invention that the upper C-ring 226 normally locks the bushing 130 to the liner hanger by being positioned within a circumferential groove or slot in the liner hanger running adapter 222. The upper C-ring 226 may come out of this groove at substantially the same time that the lower C-ring 234 snaps into groove 233, which locks the bushing to the slick joint.

Those skilled in the art should appreciate that the C-ring 226 and the C-ring 234 are the preferred type of locking member for cooperation with the groove, although other locking members may be used, including a plurality of circumferentially arranged and radially moveable pistons, buttons, plungers, lugs or dogs, which are axially connected with the bushing. In either case, the locking member(s) circumferentially occupy a majority of the circumferential groove when in a locked position, and preferably occupy at least 75% of a 360° circumferential groove. Similarly, the button, pistons, or plungers 232 are the preferred type of mechanism which radially moves relative to the locking groove, such that when these buttons are moved radially inward, the C-ring 234 unlocks the cementing bushing from the slick joint. Other forms of dogs, lugs, or another C-ring may be used to serve the purpose of the loading and/or locking functions. The circumferential groove into which the locking member fits preferentially is a 360° groove when receiving a C-ring. For other types of members, such as dogs or lugs, the receiving groove may also be a full 360° circumferential groove, although arcuate slots separated by a short arcuate wall between slots alternatively may be used.

As an alternative to the function served by the upper cam surface 240 of the groove 228, other mechanisms may be used to release the bushing 130 from the liner hanger. The function of surface 240 is to keep bushing 130 in place until the C-ring 234 snaps into groove 233 in housing 230. The bushing 130 and the C-ring 226 may be easily be stabbed back into the liner hanger and then the bushing locked to the liner. Providing a cam surface 240 for the upper end of the groove 228 is preferable due to simplicity. The purpose of the cam surface 241 at the lower end of the groove 228 is to provide a member which will force the buttons radially inward, and thereby collapse inward the outwardly biased C-ring 234, thereby unlocking the slick joint from the bushing. While these functions may be served with a single groove 228 as depicted, more than one groove may be provided, so that a cam surface of one groove serves to lock the upper C-ring, and a cam surface at the lower end of another groove serves to unlock the lower C-ring and thus unlock the slick joint from the bushing. In still other applications, the function served by the lower C-ring 234 and the buttons 232 may be combined, so that a single C-ring would serve this purpose. Outer projections on the C-ring may thus engage a cam surface similar to surface 240 in groove 228 and force the outwardly biased lower C-ring radially inward, thereby unlocking the slick joint from the bushing, without utilizing the buttons. Dogs, lugs, or other members may be used to serve the purpose of the C-rings.

Another type of cam surface or another camming mechanism may be used for pushing in the buttons and pushing in the lower C-ring to unlock the bushing from the slick joint. In still another variation, the lower C-ring could be provided on the cementing bushing, and may be biased radially inward, but be prevented from moving inward by the radially outer surface of the slick joint. A groove in the outer surface of the slick joint may form a reduced diameter outer surface, so that an inwardly biased C-ring may lock into the groove, thereby axially connecting the bushing and slick joint. When the upper C-ring is locked into the groove 228, downward movement of the slick joint may engage the cam surface at the upper end of the groove in the slick joint, with this cam surface forcing the lower C-ring radially outward, and unlocking the bushing from the liner hanger.

In many applications, the bushing is used by the well operator for various fluid circulation purposes, including circulation prior to cementing. The bushing is also commonly used to conduct cementing operations, as is well known in the art. In other applications, the cementing bushing may be used for performing downhole operations other than those involving a liner hanger, including various types of other downhole cementing tools.

Various types of subassemblies may be used to secure the liner within the casing. A slip assembly is a preferred type of apparatus for serving this purpose, but other types of subassemblies may be used to axially secure the liner within the well.

While preferred embodiments of the present invention have been illustrated in detail, it is apparent that modification and adaptations of the preferred embodiments will occur to those skilled in the art. However, it is to be expressly understood that such modifications and adaptations are within the spirit and scope of the present invention as set forth in the following claims.

What is claimed is:

1. A liner hanger assembly, comprising:

a running tool mandrel supported on a running string;

a liner hanger for engaging a casing to support a liner hanger and liner from the casing;

a releasing mechanism for releasing a portion of the liner hanger assembly to be retrieved to the surface from a portion of liner hanger assembly remaining downhole;

a slick joint supported on the running string;

a cementing bushing reinsertable into the liner hanger for interconnection to the liner hanger, the cementing bushing including one or more loading members occupying a majority of a circumferential groove in the liner hanger assembly when in a loading position, and radially movable to connect the cementing bushing to the liner hanger and withstand fluid pressure forces on the cementing bushing, the one or more loading members being radially movable to retract from the groove to disconnect the cementing bushing from the liner hanger assembly; and a locking member radially moveable to connect the cementing bushing to the slick joint, the locking member positioned within a recess in the slick joint to axially connect the cementing bushing to the slick joint, and radially retractable from the recess in the slick joint to disconnect the cementing bushing from the slick joint.

2. A liner hanger assembly as defined in claim 1, wherein the cementing bushing body seals with the portion of the liner hanger assembly to be retrieved to the surface and also seals with the liner hanger.

3. A liner hanger assembly as defined in claim 1, wherein the loading member comprises a C-ring.

4. A liner hanger assembly as defined in claim 1, wherein the loading member is supported on a liner hanger.

5. A liner hanger assembly as defined in claim 1, wherein the cementing bushing is reinsertable in the liner hanger after setting the liner hanger and releasing the portion of the liner hanger to be returned to the surface from the portion of the liner hanger remaining downhole.

6. A liner hanger assembly as defined in claim 1, further comprising:

a plurality of buttons moveable radially outward to axially connect the bushing body to the slick joint and moveable radially inward to collapse the locking member and disconnect the bushing body from the slick joint.

7. A liner hanger assembly as defined in claim 1, wherein the loading member moves radially out of the groove in the liner hanger substantially simultaneously with the locking member connecting the cementing bushing to the slick joint.

8. A liner hanger assembly as defined in claim 1, wherein the cementing bushing is released from the liner hanger when the cementing bushing body is locked to the slick joint.

9. A liner hanger assembly as defined in claim 1, further comprising:

a cam surface for acting on the one or more loading members for locking the cementing bushing body to the liner hanger assembly.

10. A liner hanger assembly, comprising:

a running tool mandrel supported on a running string;

a liner hanger for engaging a casing to support a liner hanger and liner from the casing;

a releasing mechanism for releasing a portion of the liner hanger assembly to be returned to the surface from a portion of the liner hanger remaining downhole;

a cementing bushing reinsertable into the liner hanger, the cementing bushing including one or more loading members occupying a majority of a circumferential groove in the liner hanger when in a locking position, each loading member being axially movable with respect to the bushing body and radially moveable for axially interconnecting the bushing body and the liner hanger, and the cementing bushing including a bushing body for sealing with the liner hanger and for sealing with the portion of the liner hanger assembly to be returned to the surface;

a slick joint supported on the running string; and a locking member radially moveable to connect the cementing bushing to the slick joint, the locking member positioned within a recess in the slick joint to axially connect the cementing bushing to the slick joint and radially retractable from the recess in the slick joint to disconnect the cementing bushing from the slick joint.

11. A liner hanger assembly as defined in claim 10, wherein the loading member comprises a C-ring.

12. A liner hanger assembly as defined in claim 10, wherein the cementing bushing is reinsertable into the liner hanger after setting the liner hanger and releasing the portion of the tool to be returned to the surface.

13. A liner hanger assembly as defined in claim 10, further comprising:

a plurality of buttons moveable radially inward to collapse the locking member and disconnect the bushing body from the slick joint.

14. A method of operating a liner hanger assembly downhole within a casing, comprising:

supporting a running tool mandrel on a running string;

engaging an apparatus with the casing to support a liner hanger and liner from the casing;

providing a reinsertable cementing bushing within the liner hanger, the cementing bushing including one or more loading members occupying a majority of a circumferential groove in the liner hanger when in a locking position;

releasing a portion of the liner hanger assembly to be retrieved to the surface from a portion of the liner hanger assembly remaining downhole;

supporting a slick joint on the running string; and radially moving a locking member to connect the cementing bushing and the slick joint.

15. A method as defined in claim 14, wherein the cementing bushing includes a bushing body for sealing with the portion of the liner hanger assembly to be retrieved to the surface and also sealing with the liner hanger.

16. A method as defined in claim 15, further comprising:

radially moving the one or more loading members to axially interconnect the bushing body and the liner hanger.

17. A method as defined in claim 14, wherein the cementing bushing is reinserted into the liner hanger after setting the apparatus and releasing the portion of the liner hanger assembly to be retrieved to the surface.

18. A method as defined in claim 14, further comprising:

moving a plurality of buttons radially inward to collapse the locking member and disconnect the bushing body from the slick joint.

19. A method as defined in claim 14, wherein the loading member is moved radially out of a respective groove substantially simultaneously with the locking member entering its respective groove.

* * * * *